US011226120B2

(12) United States Patent
Jang et al.

(10) Patent No.: US 11,226,120 B2
(45) Date of Patent: Jan. 18, 2022

(54) OUTDOOR UNIT OF AIR CONDITIONER

(71) Applicant: Samsung Electronics Co., Ltd., Suwon-si (KR)

(72) Inventors: Keun Jeong Jang, Suwon-si (KR); Wan Soo Yang, Suwon-si (KR); Eun Sung Jo, Suwon-si (KR); Hyun Wuk Kang, Suwon-si (KR); Hyeon U Park, Suwon-si (KR); Jei Min Choi, Suwon-si (KR); Bu Youn Lee, Suwon-si (KR); Wang Byung Chae, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 160 days.

(21) Appl. No.: 16/568,158

(22) Filed: Sep. 11, 2019

(65) Prior Publication Data

US 2020/0088421 A1 Mar. 19, 2020

(30) Foreign Application Priority Data

Sep. 14, 2018 (KR) ..... 10-2018-0110365

(51) Int. Cl.
*F25D 17/06* (2006.01)
*F24F 1/38* (2011.01)
(Continued)

(52) U.S. Cl.
CPC ..... *F24F 1/38* (2013.01); *F04D 29/545* (2013.01); *F24F 1/50* (2013.01); *F24F 1/56* (2013.01)

(58) Field of Classification Search
CPC ..... F24F 1/38; F24F 1/50; F24F 1/56; F04D 29/541; F04D 19/002; F04D 29/545; F04D 29/54; F05D 2240/126
See application file for complete search history.

(56) References Cited

U.S. PATENT DOCUMENTS

2014/0102131 A1* 4/2014 Okamoto ..... F24F 1/16 62/510
2016/0187005 A1* 6/2016 Kwon ..... F24F 1/38 62/259.1

(Continued)

FOREIGN PATENT DOCUMENTS

GB 2550588 A 11/2017
JP 2004-239579 A 8/2004

(Continued)

OTHER PUBLICATIONS

International Search Report dated Jan. 3, 2020 in connection with International Patent Application No. PCT/KR2019/011864, 3 pages.

(Continued)

*Primary Examiner* — Henry T Crenshaw
*Assistant Examiner* — Kamran Tavakoldavani

(57) ABSTRACT

An outdoor unit of an air conditioner includes a housing including an outlet, a fan disposed inside the housing, and a guide guiding air flowing by the fan, wherein the guide includes an inflow portion provided to guide air introduced into the housing to the fan and a diffuser extending from the inflow portion to guide air passing through the fan to the outlet. The inflow portion includes a duct connected to the diffuser, a bell mouth disposed on an upstream side further than the duct and configured such that a width of an inlet end of the bell mouth is wider than a width of an outlet end of the bell mouth, and a guide vane formed on the bell mouth and configured to guide air introduced into the fan.

20 Claims, 12 Drawing Sheets

(51) Int. Cl.

| | |
|---|---|
| ***F04D 29/54*** | (2006.01) |
| ***F24F 1/56*** | (2011.01) |
| ***F24F 1/50*** | (2011.01) |

(56) References Cited

U.S. PATENT DOCUMENTS

| | | | | |
|---|---|---|---|---|
| 2016/0281739 | A1* | 9/2016 | Nakagawa | F04D 29/667 |
| 2016/0305452 | A1 | 10/2016 | Nakagawa et al. | |
| 2018/0259201 | A1 | 9/2018 | Sato | |

FOREIGN PATENT DOCUMENTS

| | | | | |
|---|---|---|---|---|
| JP | 2009-024595 | A | | 2/2009 |
| JP | 2010-242597 | A | | 10/2010 |
| KR | 10-2002-0039485 | A | | 5/2002 |
| KR | 10-2003-0035328 | A | | 5/2003 |
| KR | 10-0772086 | B1 | | 10/2007 |
| KR | 10-2013-0067936 | A | | 6/2013 |
| KR | 20130067936 | A | * | 6/2013 |
| KR | 10-2017-0140899 | A | | 12/2017 |
| WO | 2008/075872 | A1 | | 6/2008 |
| WO | 2009011350 | A1 | | 1/2009 |

OTHER PUBLICATIONS

Supplementary European Search Report dated Sep. 8, 2021, in connection with European Application No. 19860510.7, 9 pages.

* cited by examiner

OUTDOOR UNIT OF AIR CONDITIONER

CROSS-REFERENCE TO RELATED APPLICATION

This application is based on and claims priority under 35 U.S.C. § 119 to Korean Patent Application No. 10-2018-0110365, filed on Sep. 14, 2018, in the Korean Intellectual Property Office, the disclosure of which is incorporated by reference herein in its entirety.

BACKGROUND

1. Field

The disclosure relates to an outdoor unit of an air conditioner, and more particularly, to an outdoor unit of an air conditioner having improved blowing efficiency.

2. Description of the Related Art

In general, an air conditioner is an apparatus for controlling temperature, humidity, airflow, distribution, and the like suitable for human activity by using a refrigeration cycle. A compressor, a condenser, an evaporator, a blower, and the like are provided as main components of the refrigeration cycle.

The air conditioner may be classified into a separate type air conditioner in which an indoor unit and an outdoor unit are separated and an integrated type air conditioner in which an indoor unit and an outdoor unit are installed together in a single cabinet. The outdoor unit of the separate type air conditioner includes a heat exchanger for heat exchanging air sucked into the outdoor unit, and a fan for blowing the heat-exchanged air back to the outside.

As the load for air conditioning increases, the blowing efficiency of the fan for discharging the heat-exchanged air to the outside may become a concern.

SUMMARY

It is an aspect of the disclosure to provide an outdoor unit of an air conditioner having an improved air exhaust structure.

It is another aspect of the disclosure to provide an outdoor unit of an air conditioner having an improved air flowing structure.

Additional aspects of the disclosure will be set forth in part in the description which follows and, in part, will be obvious from the description, or may be learned by practice of the disclosure.

In accordance with an aspect of the disclosure, an outdoor unit of an air conditioner includes a housing including an outlet, a fan disposed inside the housing, and a guide guiding air flowing by the fan, wherein the guide includes an inflow portion provided to guide air introduced into the housing to the fan and a diffuser extending from the inflow portion to guide air passing through the fan to the outlet, and the inflow portion includes a duct connected to the diffuser, a bell mouth disposed on an upstream side further than the duct and configured such that a width of an inlet end of the bell mouth is wider than a width of an outlet end of the bell mouth, and a guide vane formed on the bell mouth and configured to guide air introduced into the fan.

The guide vane may be configured to be curved from a first end that is an arbitrary point on the inner surface of the bell mouth to a second end that is an outlet end of the inner surface of the bell mouth.

The curvature from the first end to the second end may be formed in a rotational direction of the fan.

The guide vane may be spirally formed from the first end to the second end and may be configured to be curved toward the outlet end of the bell mouth.

The bell mouth may be formed to slantly expand from the duct in a direction from the outlet end to the inlet end, and the guide vane may be formed on the inner surface of the inclined bell mouth.

The bell mouth may be configured such that the inclination of the inner surface of the bell mouth increases toward the inlet end from the outlet end.

The duct, the bell mouth, the guide vane, and the diffuser may be integrally injection-molded.

When an angle between an imaginary extension line extending from the second end of the guide vane and a perpendicular line directing to the second end of the guide vane from a center line passing through the center of the guide vane is referred to as an outlet angle, the guide vane may be configured to have a longer length as the outlet angle increases.

An angle (D degrees) between a center line passing through the rotation center of the fan and a tangent line at an outlet end of the diffuser may satisfy the following.

$$3 \leq D \leq 35$$

The guide vane may include a concave inner curved surface and a convex outer curved surface that is the other side of the concave inner curved surface, and the guide vane may be configured such that the inner curved surface directs to an upstream side of the bell mouth and at least a portion thereof lies.

The guide vane may be formed to protrude further toward an upstream side of the guide than the inlet end of the bell mouth.

The guide vane may be configured to be inclined in a rotational direction of the fan from the first end to the second end.

The diffuser may be formed to slantly extend from the duct in a direction from the inlet end to the outlet end, and the guide may include a diffuser vane configured to be curved from a first end that is the inlet end of the diffuser to a second end that is an arbitrary point of the diffuser.

The fan may include an axial flow fan for blowing air introduced into the bell mouth to the diffuser.

In accordance with an aspect of the disclosure, an outdoor unit of an air conditioner includes a housing provided with an outlet, a fan disposed inside the housing, and a guide guiding air flowing by the fan, wherein the guide includes a duct configured to accommodate the fan, a diffuser extending from an outlet end of the duct to discharge air passing through the fan, a bell mouth extending from an inlet end of the duct and configured such that a width of an inlet end of the bell mouth is wider than a width of an outlet end of the bell mouth, and a guide vane formed on the bell mouth and configured to be curved to guide air introduced into the fan, the guide vane includes a first end positioned at the outlet end of the bell mouth and a second end opposite to the first end, and the guide vane is configured to be inclined in a rotational direction of the fan from the first end to the second end.

The guide vane may be configured to be gradually inclined from the first end to the second end.

The guide vane may be formed to protrude further toward an upstream side of the guide than the inlet end of the bell mouth.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
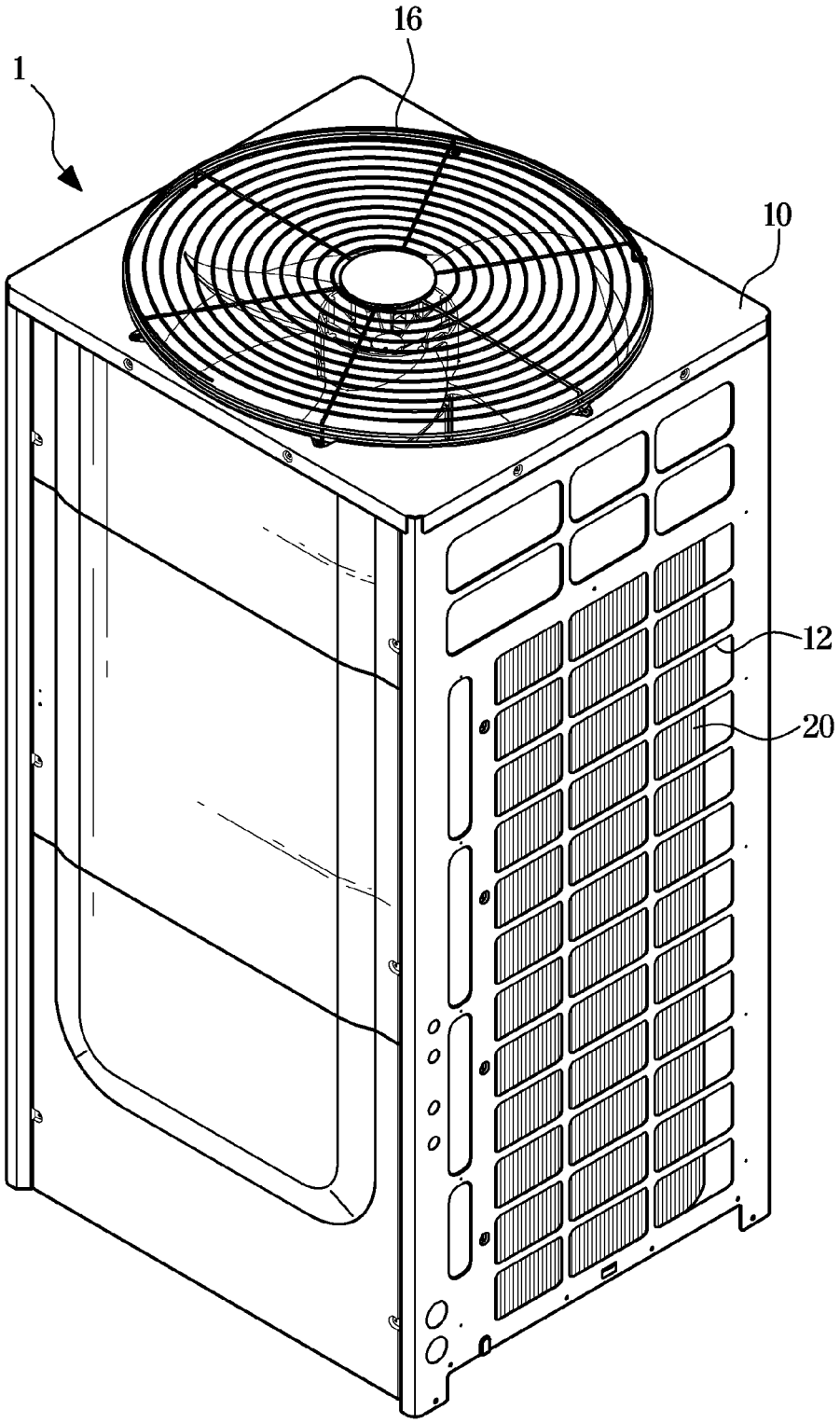
FIG. 1 illustrates a perspective view of an outdoor unit of an air conditioner according to an embodiment of disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments described in the present specification and the configurations shown in the drawings are only examples of various embodiments of the disclosure, and various modifications may be made at the time of filing of the disclosure to replace the embodiments and drawings of the present specification.

Like reference numerals or signs in the respective drawings of the present specification represent parts or components that perform substantially the same functions.

The terms used in the present specification are for the purpose of describing the embodiments and are not intended to restrict and/or to limit the disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

Hereinafter embodiments according to the disclosure will be described in detail with reference to the accompanying drawings.

A refrigeration cycle of an air conditioner includes of a compressor, a condenser, an expansion valve, and an evaporator. The refrigeration cycle performs a series of processes including compression-condensation-expansion-evaporation, thereby heat exchanging a high-temperature air with a low-temperature refrigerant to supply a low-temperature air to a room.

The compressor compresses a refrigerant gas to be in a state of high temperature and high pressure and then discharges the compressed refrigerant gas to flow into the condenser. The condenser condenses the compressed refrigerant into a liquid phase and releases heat to the surroundings through the condensation process. The expansion valve expands the liquid refrigerant in a high-temperature and high-pressure state condensed in the condenser to the liquid refrigerant in a low-pressure state. The evaporator evaporates the refrigerant expanded in the expansion valve. The evaporator achieves the refrigerating effect by heat exchange with an object to be cooled using the latent heat of evaporation of refrigerant and returns the refrigerant gas in the low-temperature and low-pressure state to the compressor. The air temperature of an indoor space may be controlled through the above cycle.

An outdoor unit of the air conditioner refers to a portion composed of the compressor and an outdoor heat exchanger in the refrigeration cycle. The expansion valve may be located either in an indoor unit or the outdoor unit, and an indoor heat exchanger is located in the indoor unit of the air conditioner.

The disclosure relates to an air conditioner for cooling an indoor space, and the outdoor heat exchanger serves as a condenser and the indoor heat exchanger serves as an evaporator. Hereinafter for the sake of convenience, the outdoor unit including the outdoor heat exchanger is referred to as an air conditioner, and the outdoor heat exchanger is referred to as a heat exchanger.

Figure 2:
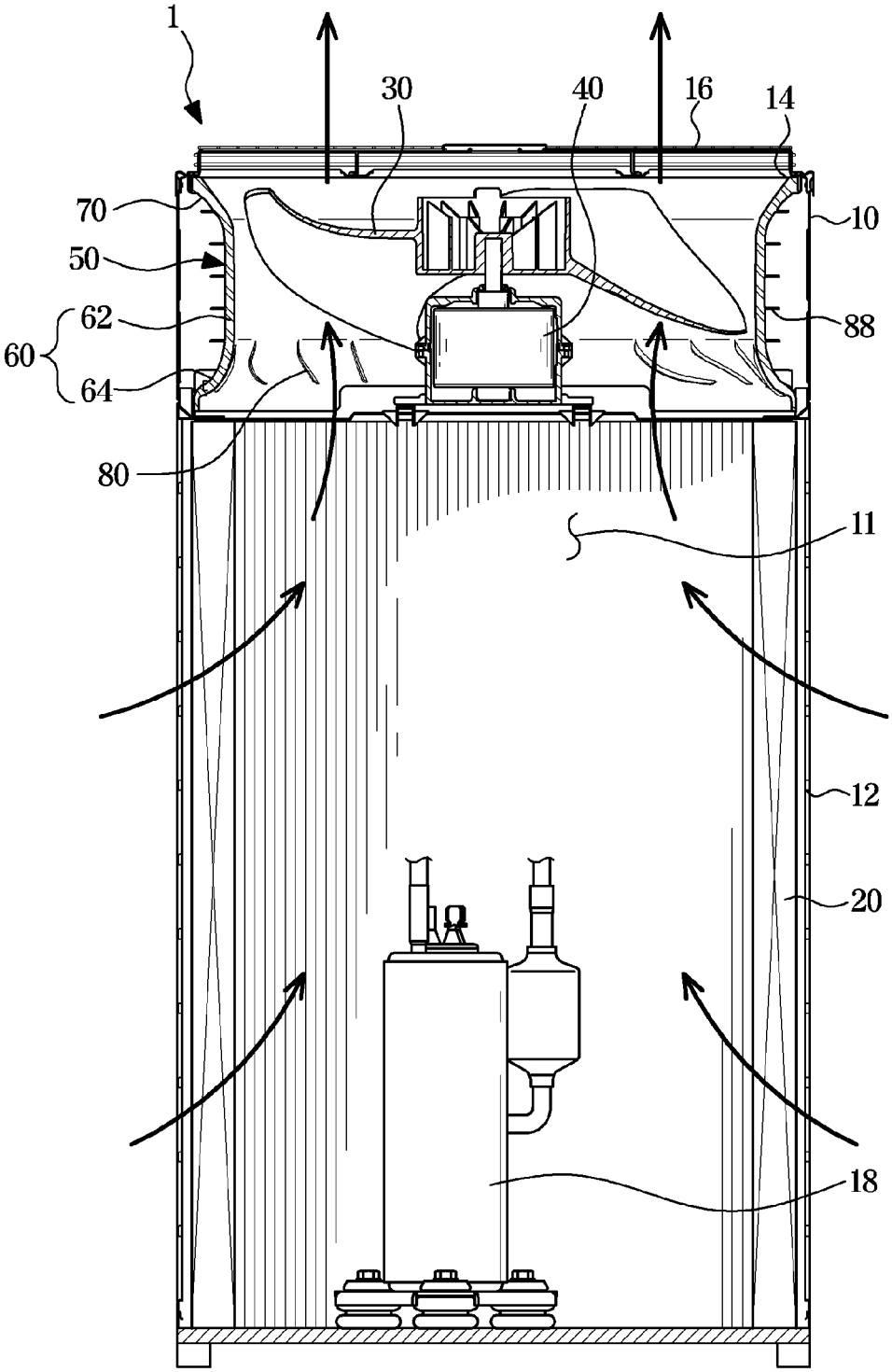
FIG. 2 illustrates a cross-sectional view of the outdoor unit of e air conditioner according to an embodiment of the disclosure.

FIG. 1 illustrates a perspective view of an outdoor unit of an air conditioner according to an embodiment of disclosure, and FIG. 2 illustrates a cross-sectional view of the outdoor unit of the air conditioner according to an embodiment of the disclosure.

An air conditioner 1 may include a housing 10 having an inlet 12 and an outlet 14 and a heat exchanger 20 for exchanging heat with the air introduced into the housing 10. The air conditioner 1 according to the present embodiment will be described on the basis of an outdoor unit of a stand type air conditioner installed on a floor surface, but is not limited thereto.

The housing 10 may be configured to form an overall outer appearance of the air conditioner 1.

Outside air may be introduced into the inside of the housing 10 through the inlet 12. The outside air introduced through the inlet 12 may be heat-exchanged with a heat exchanger 20. The outlet 14 is provided such that the heat-exchanged air in the heat exchanger 20 may be discharged to the outside of the housing 10. In the present embodiment, the outlet 14 is disposed on an upper surface of the housing 10, but the position of the outlet 14 is not limited thereto. The outlet 14 may be provided with a grill 16 for preventing foreign substances from entering from the outside and damaging a fan. Components of a refrigeration cycle including a compressor 18 may be arranged inside the housing 10. In the present embodiment, description of connections and arrangements among the respective components is omitted.

The heat exchanger 20 may be disposed on a moving path 11 of air flowing from the inlet 12 to the outlet 14. Air introduced from the outside is heat-exchanged with the heat exchanger 20, and the heat-exchanged air may be discharged to the outlet 14.

The air conditioner 1 may include a fan 30 and a fan motor 40.

The fan 30 may be configured to circulate air into or out of the housing 10.

The fan 30 is configured such that outside air may be discharged to the outside through the inside of the housing 10. The fan 30 is configured to allow air to flow from the inlet 12 to the outlet 14.

The fan 30 may be disposed at the center of a guide 50. An upstream end 30*a* (refer to FIG. 3) of the fan 30 may be disposed upstream of an inlet end 62*a* of a duct 62, and a downstream end 30*b* (refer to FIG. 3) of the fan 30 may be disposed downstream of an outlet end 62*b* of the duct 62. That is, the length of the fan 30 in the direction of a center line C of the fan 30 may be longer than the length of the duct 62. The fan 30 may include an axial flow fan for blowing air to the rear of the guide 50 from the front of the guide 50.

The fan motor 40 is configured to generate a driving force for rotating the fan 30. The fan motor 40 may be disposed at the center of the fan 30.

The air conditioner 1 may include the guide 50.

The guide 50 may be configured such that the fan 30 is positioned inside thereof. The guide 50 is configured to guide the flow of air moving from the inlet 12 to the outlet 14.

Figure 3:
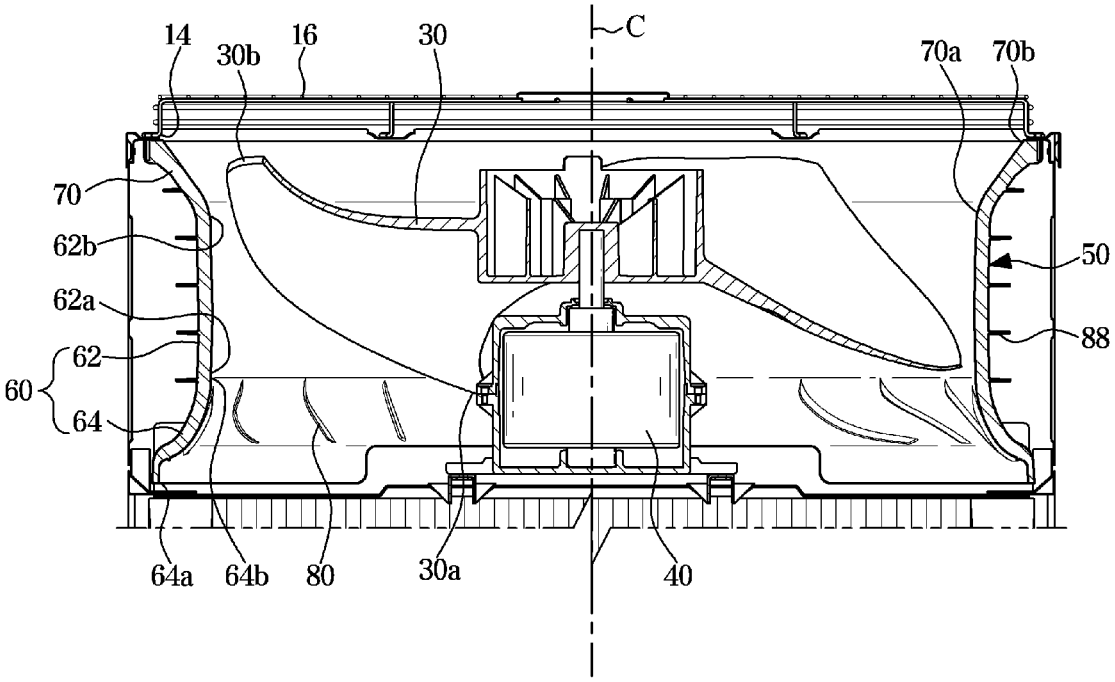
FIG. 3 illustrates a cross-sectional view of a fan and a guide of the outdoor unit of the air conditioner according to an embodiment of the disclosure.
Figure 4:
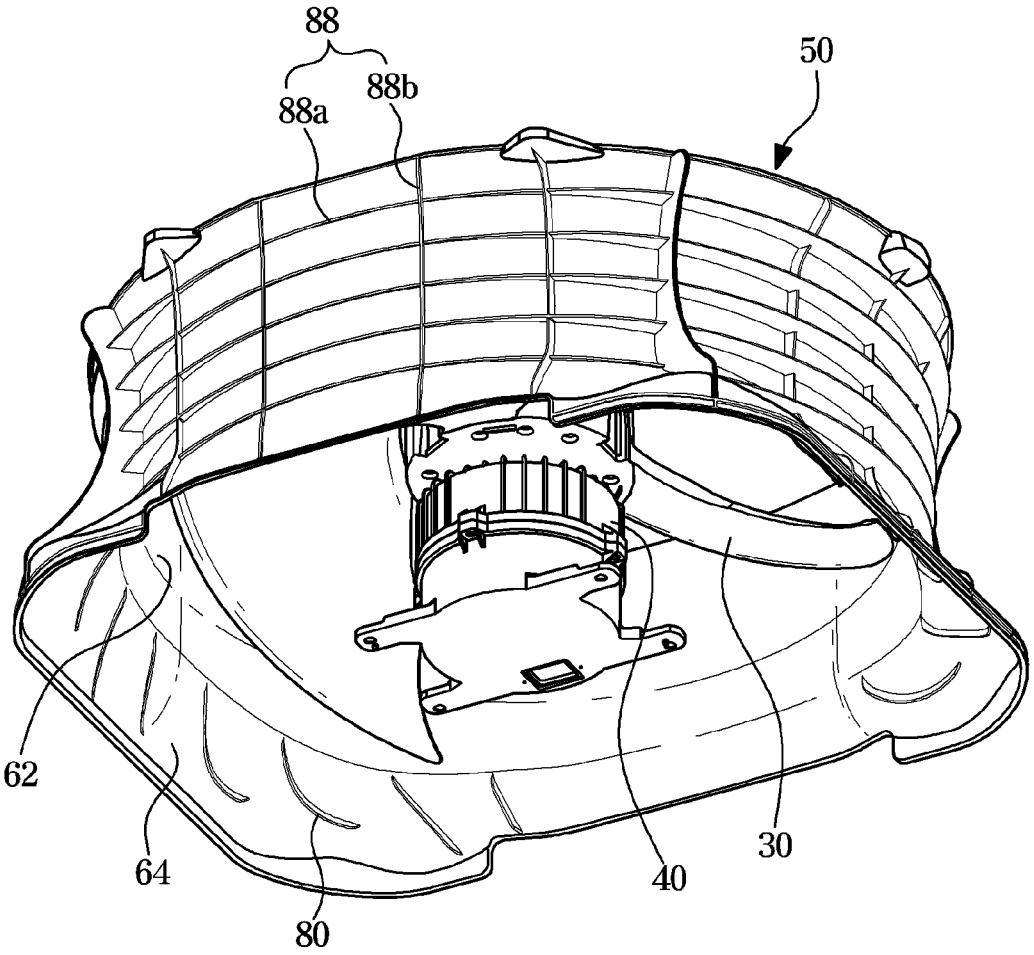
FIG. 4 illustrates a perspective view of the fan and the guide of the outdoor unit of the air conditioner according to an embodiment of the disclosure.

FIG. 3 illustrates a cross-sectional view of a fan and a guide of the outdoor unit of the air conditioner according to an embodiment of the disclosure, and FIG. 4 illustrates a perspective view of the fan and the guide of the outdoor unit of the air conditioner according to an embodiment of the disclosure.

The guide 50 may include an inflow portion 60 and a diffuser 70.

The inflow portion 60 may include a bell mouth 64 and the duct 62. The guide 50 may be disposed in the order of the bell mouth 64, the duct 62, and the diffuser 70 along an air flow direction. For convenience of description, when a line passing through the center of rotation of the fan 30 is defined as the center line C as shown in FIG. 3, the bell mouth 64, the duct 62, and the diffuser 70 may also be arranged such that their centers are located on the center line C. The bell mouth 64, the duct 62, and the diffuser 70 may be integrally injection-molded.

The bell mouth 64 is disposed upstream of the duct 62 so as to guide the air introduced into the inlet 12 to the fan 30.

The bell mouth 64 may be formed such that the width of an opening forming an outlet end 64*b* thereof is narrower than the width of an opening forming an inlet end 64*a* thereof. That is, the bell mouth 64 may be formed to narrow from the inlet end 64*a* toward the outlet end 64*b*. The bell mouth 64 may be formed to slantly expand from the duct 62 toward the inlet end 64*a* from the outlet end 64*b*. The inclination of the inner surface of the bell mouth 64 may be configured to increase from the outlet end 64*b* to the inlet end 64*a*. In the description of the present embodiment, the inlet end 64*a* may have the same meaning as the upstream end of the configuration and the outlet end 64*b* may have the same meaning as the downstream end of the configuration.

The duct 62 is disposed downstream of the bell mouth 64 in the air flow direction and may be configured to extend from the bell mouth 64. The duct 62 may be formed in a substantially cylindrical shape. The duct 62 may be configured such that an opening of the inlet end 62*a* thereof and an opening of the outlet end 62*b* thereof have the same width. The inlet end 62*a* of the duct 62 and the outlet end 64*b* of the bell mouth 64 may be at the same position.

The diffuser 70 is configured to extend from the inflow portion 60 to guide the air passing through the fan 30 to the outlet 14. The diffuser 70 may be configured to extend from the duct 62.

The diffuser 70 may be formed such that the width of an opening forming an outlet end 70*b* thereof is wider than the width of an opening forming an inlet end 70*a* thereof. That is, the diffuser 70 may be formed to widen from the inlet end 70*a* toward the outlet end 70*b*.

The outlet end 70*b* of the diffuser 70 may be formed in an elliptical shape. The inlet end 70*a* of the diffuser 70 may be formed in a substantially circular shape to correspond to the outlet end 62*b* of the duct 62. Because the outlet end 70*b* of the diffuser 70 is formed in an elliptical shape while the inlet end 70*a* of the diffuser 70 is formed in a circular shape, an inclination angle (D degrees) formed by the diffuser 70 with the duct 62 may be formed differently along the circumference thereof. The inclination angle (D degrees) may satisfy the following.

$$3 \leq D \leq 35$$

The guide 50 may include a guide vane 80.

The guide vane 80 is configured to guide the air entering the fan 30. The guide vane 80 may be provided in the bell mouth 64.

The bell mouth 64 is configured to slantly expand further than the duct 62 and the guide vane 80 may be formed on the inner surface of the bell mouth 64. The guide vane 80 may be injection-molded integrally with the bell mouth 64. Because the bell mouth 64, the duct 62, and the diffuser 70 are integrally formed, the guide vane 80 may also be integrally formed together with them.

The guide vane 80 is configured to change a flow of the air introduced into the fan 30. That is, the guide vane 80 is configured to change a flow of air passing through the bell mouth 64. Specifically, the guide vane 80 is configured to generate airflow inclined along a rotational direction of the fan 30, rather than in a direction parallel to the center line C passing through the center of rotation of the fan 30. The guide vane 80 changes the airflow of air introduced into the fan 30 to the rotating direction of the fan 30 so that the flow rate of air introduced into the fan 30 may increase. As the flow rate of air introduced by the fan 30 increases, the heat exchange efficiency of the heat exchanger 20 may be improved.

The guide 50 may include a reinforcing portion 88.

The reinforcing portion 88 may be formed on the outer surfaces of the inflow portion 60 and the diffuser 70. The reinforcing portion 88 is disposed on the outer surface of the guide 50, so that the durability of the guide 50 may be improved. The reinforcing portion 88 also may prevent the guide 50 from being thermally deformed by the temperature of air flowing through the guide 50. The reinforcing portion 88 also may prevent deformation of the bell mouth 64, the duct 62 and the diffuser 70, thereby preventing the air flow space formed by them from being deformed. The reinforcing portion 88 may be integrally injection-molded together with the bell mouth 64, the duct 62, and the diffuser 70.

The reinforcing portion 88 may include horizontal reinforcing members 88*a* and vertical reinforcing members 88*b*. The horizontal reinforcing member 88*a* may be configured to protrude from the outer surface of the guide 50 in a direction perpendicular to the center line C. The vertical reinforcing member 88*b* may be configured to protrude from the outer surface of the guide 50 in a direction parallel to the center line C.

Because the vertical reinforcing members 88*b* are integrally injection-molded together with the bell mouth 64, the duct 62, and the diffuser 70, the vertical reinforcing members 88*b* may extend from the bell mouth 64 to the diffuser 70 along the outer surface of the bell mouth 64 and the diffuser 70 without a disconnected section.

Figure 5:
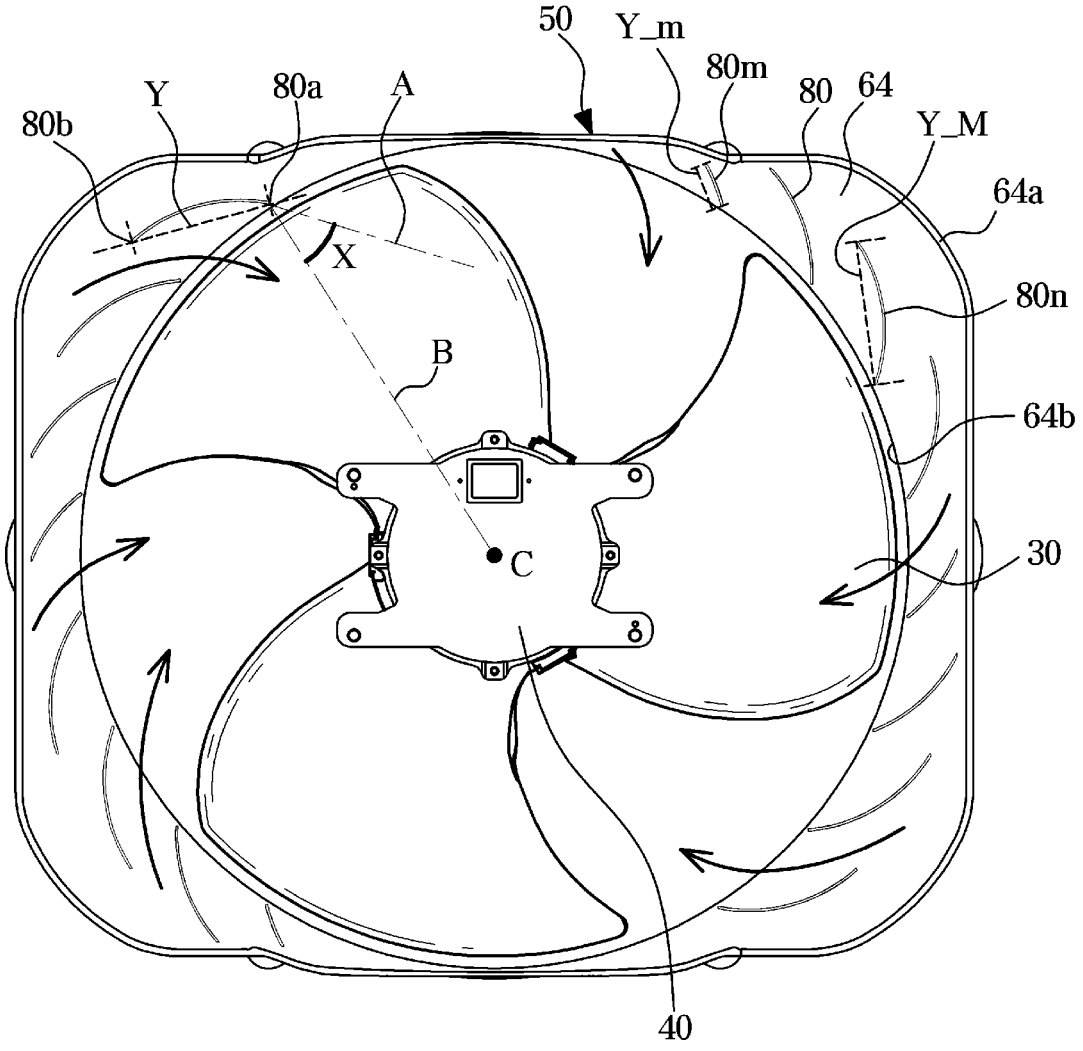
FIG. 5 illustrates a front view of the fan and the guide of the outdoor unit of the air conditioner according to an embodiment of the disclosure.

FIG. 5 illustrates a front view of the fan and the guide of the outdoor unit of the air conditioner according to an embodiment of the disclosure.

The guide vane 80 is configured to extend from an arbitrary point on the inner surface of the bell mouth 64 to the outlet end 64*b* of the bell mouth 64. However, the disclosure is not limited thereto, and the guide vane 80 may extend from the inlet end 64*a* to the outlet end 64*b* of the bell mouth 64. The guide vane 80 may be configured to protrude spirally from the inner surface of the bell mouth 64 and to be curved toward the outlet end of the bell mouth 64 as the guide vane 80 extends to the outlet end of the bell mouth 64. Because the guide vane 80 is formed up to the outlet end 64*b* of the bell mouth 64, the guide vane 80 is configured so as not to affect the inner diameter of the duct 62. With this configuration, the fan 30 may not be interfered with the guide vane 80 even when the fan 30 is disposed to protrude beyond the inlet end 62*a* of the duct 62.

The guide vane 80 may be configured to be curved along the rotational direction of the fan 30. The guide vane 80 may be configured to have a curvature.

When an end portion of the guide vane 80 close to the inlet end 64*a* of the bell mouth 64 is referred to as a first end portion 80*b* and an end portion of the guide vane 80 close to the outlet end 64*b* of the bell mouth 64 is referred to as a second end portion 80*a*, the guide vane 80 may be configured to be curved from the first end portion 80*b* to the second end portion 80*a*. The guide vane 80 may be configured to be curved from the first end portion 80*b* to the second end portion 80*a* in the rotational direction of the fan 30. The guide vane 80 may be configured to be gradually curved from the first end portion 80*b* to the second end portion 80*a* in the rotational direction of the fan 30. The guide vane 80 may be configured to have the same curvature from the first end portion 80*b* to the second end portion 80*a*. However, the disclosure is not limited thereto, and the guide vane 80 may be configured such that the curvature at any first portion of the guide vane 80 is different from the curvature at a second portion that is spaced apart from the first portion.

As illustrated in FIG. 5, when the guide 50 and the fan 30 are viewed from the front, an angle between an extension line A that is a tangent line at the second end portion 80*a* of the guide vane 80 and a perpendicular line B connecting from the center line C to the second end portion 80*a* of the guide vane 80 may be referred to as an outlet angle (X degrees). The distance of a straight line connecting the first end portion 80*b* and the second end portion 80*a* of the guide vane 80 may be referred to as Y (mm).

In this embodiment, one guide vane of a plurality of the guide vanes that is located at an arbitrary point is configured such that the outlet angle is X degrees and the straight distance is Y (mm). However, the disclosure is not limited thereto, and when the guide vane is configured such that, the outlet angle is Xa smaller than X, the guide vane may be configured such that the straight distance is Ya mm) shorter than Y (mm). On the contrary, when the outlet angle is provided to be Xb larger than X, the straight distance may be provided to be Yb (mm) longer than Y (mm).

The inlet end 64*a* of the bell mouth 64 is formed in a substantially rectangular shape and the outlet end 64*b* of the bell mouth 64 may be formed in a substantially circular shape. With this configuration, the bell mouth 64 may be configured such that the length from the inlet end 64*a* to the outlet end 64*b* is different at each point. With this configuration, the guide vane 80 may be configured such that, the straight distance Y (mm) is different according to each point. For example, the guide vane 80 positioned at an section of the bell mouth 64 having the shortest length from the inlet end 64*a* to the outlet end 64*b* may be referred to as a first guide vane 80*m*, and the guide vane 80 positioned at an section of the bell mouth 64 having the longest length from the inlet end 64*a* to the outlet end 64*b* may be referred to as a second guide vane 80*n*. When the straight distance of the first guide vane 80*m* is Y_m and the straight distance of the second guide vane 80*n* is Y_M, Y_m may be configured to be shorter than Y_M. The straight distance Y_M of the second guide vane 80*n* may be configured to be less than five times the straight length Y_m of the first guide vane 80*m*. The outlet angles of the first and second guide vanes 80*m* and 80*n* may be configured to be equally X degrees.

Figure 6A:
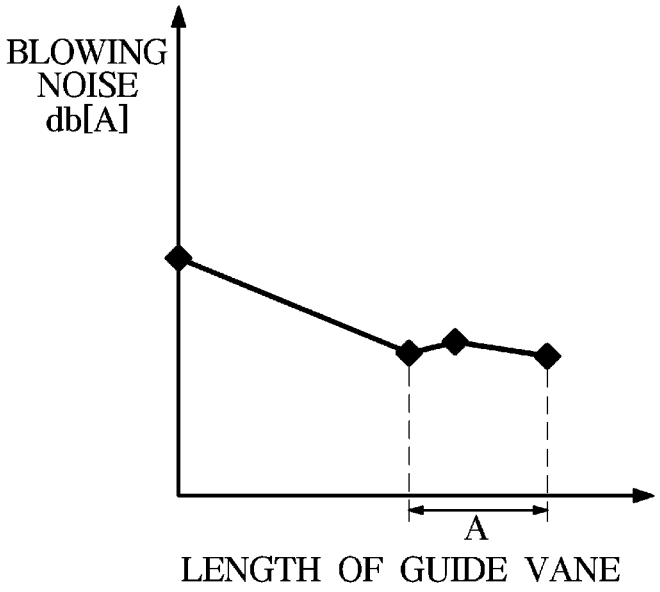
FIGS. 6A and 6B are graphs illustrating blowing noise and power consumption according to the length of a guide vane of the outdoor unit of the air conditioner according to an embodiment of the disclosure.
Figure 6B:
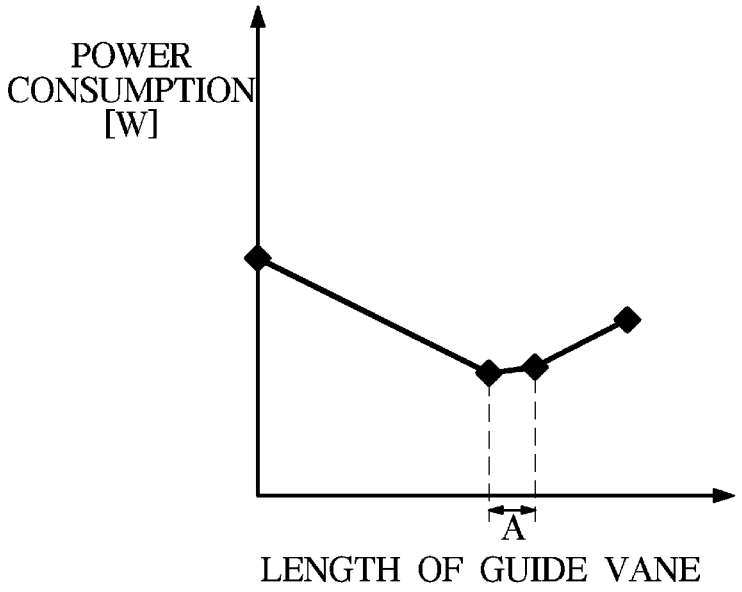

FIGS. 6A and 6B are graphs illustrating blowing noise and power consumption according to the length of a guide vane of the outdoor unit of the air conditioner according to an embodiment of the disclosure.

A distance of a straight line connecting the first end portion 80*b* and the second end portion 80*a* of the guide vane 80 may be defined as Y (mm), and an outlet angle may be defined as X degrees.

As mentioned above, X may be appropriately varied depending on the length of Y. When the length of Y varies, an appropriate length A that lowers noise and power consumption may be found. In these conditions, the curvature of the guide vane 80 may be provided to be constant from the first end portion 80*b* to the second end portion 80*a*.

Hereinafter an air conditioner according to another embodiment of the disclosure will be described.

A duplicate description of the same configuration as the above-described configuration will be omitted.

Figure 7:
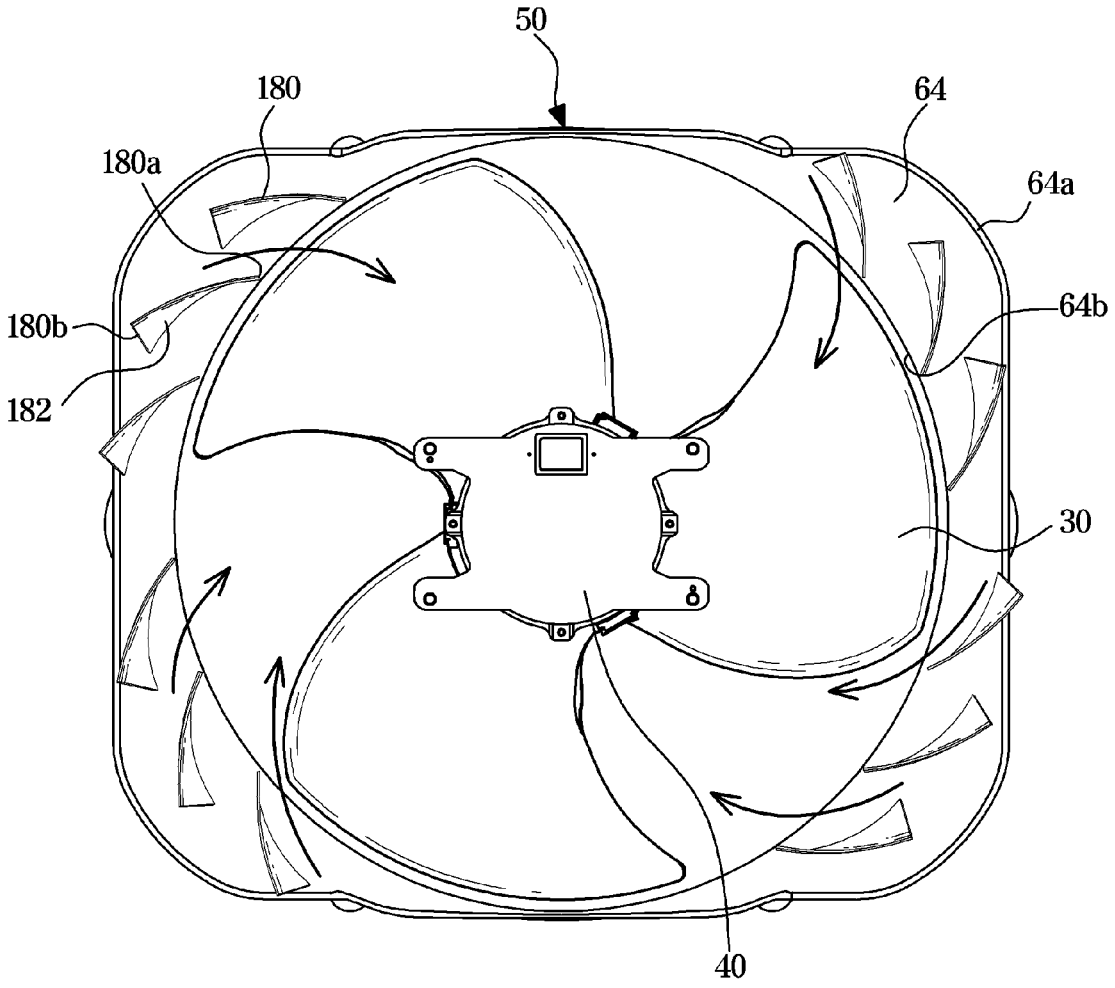
FIG. 7 illustrates a front view of a fan and a guide of an outdoor unit of an air conditioner according to another embodiment of the disclosure.
Figure 8:
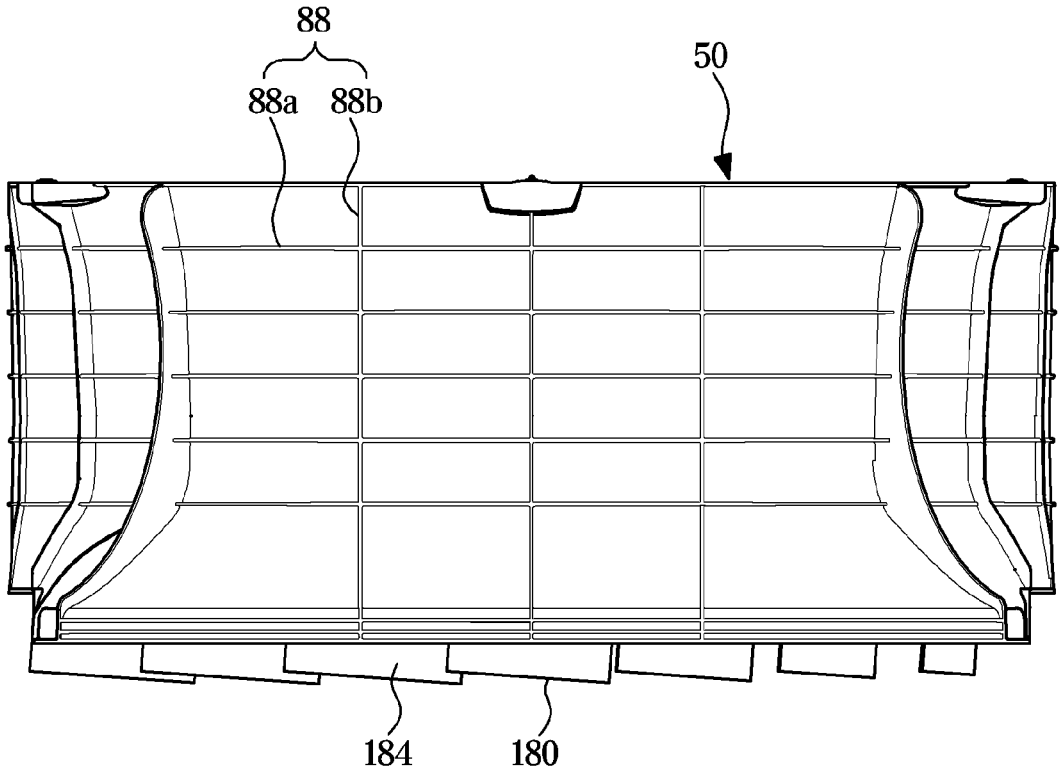
FIG. 8 illustrates a side view of the fan and the guide of the outdoor unit of the air conditioner according to another embodiment of the disclosure.

FIG. 7 illustrates a front view of a fan and a guide of an outdoor unit of an air conditioner according to another embodiment of the disclosure, and FIG. 8 illustrates a side view of the fan and the guide of the outdoor unit of the air conditioner according to another embodiment of the disclosure.

A guide vane 180 may be configured such that at least a portion thereof lies toward the inlet end 64*a* of the bell mouth 64. That is, at least a portion of the guide vane 180 may be provided to lie.

The guide vane 180 may have a concave curved surface on one side and a convex curved surface on the other side. One side of the guide vane 180 may be referred to as an inner curved surface 182 and the other side may be referred to as an outer curved surface 184 (refer to FIG. 8). The guide vane 180 may be configured such that the inner curved surface 182 is inclined toward the upstream of the bell mouth 64. The guide vane 180 may be configured such that the outer curved surface 184 is inclined toward the inner surface of the bell mouth 64. That is, at least a portion of the guide vane 180 may be provided to be inclined so that the inner curved surface 182 directs to the front of the bell mouth 64 and the outer curved surface 184 directs to the inner surface of the bell mouth 64.

The guide vane 180 may be configured such that a second end portion 180*a* is positioned in parallel with the direction of the center C and a first end portion 180*b* is positioned in parallel with the direction of the center line C and is inclined in the rotational direction of the fan 30.

As such, as the guide vane 180 is arranged such that its end portion is inclined, an airflow is generated in the air introduced into the bell mouth 64 so that the inflow amount of the air introduced into the fan 30 may be increased.

The guide vane 180 may be configured to protrude toward the upstream side of the guide 50 than the inlet end 64*a* of the bell mouth 64. That is, the guide vane 180 may be configured to protrude more than the guide 50. With this configuration, the guide vane 180 may change airflow of a large amount introduced into the guide 50.

Hereinafter an air conditioner according to another embodiment of the disclosure will be described.

A duplicate description of the same configuration as the above-described configuration will be omitted.

Figure 9:
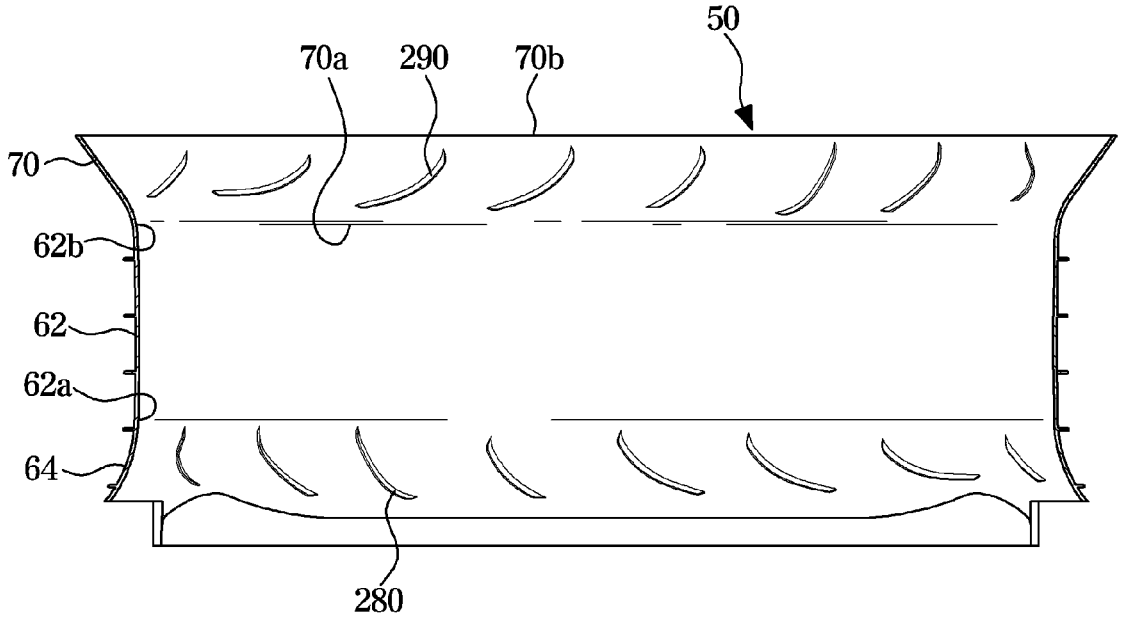
FIG. 9 is a view illustrating a guide of an outdoor unit of an air conditioner according to another embodiment of the disclosure.
Figure 10:
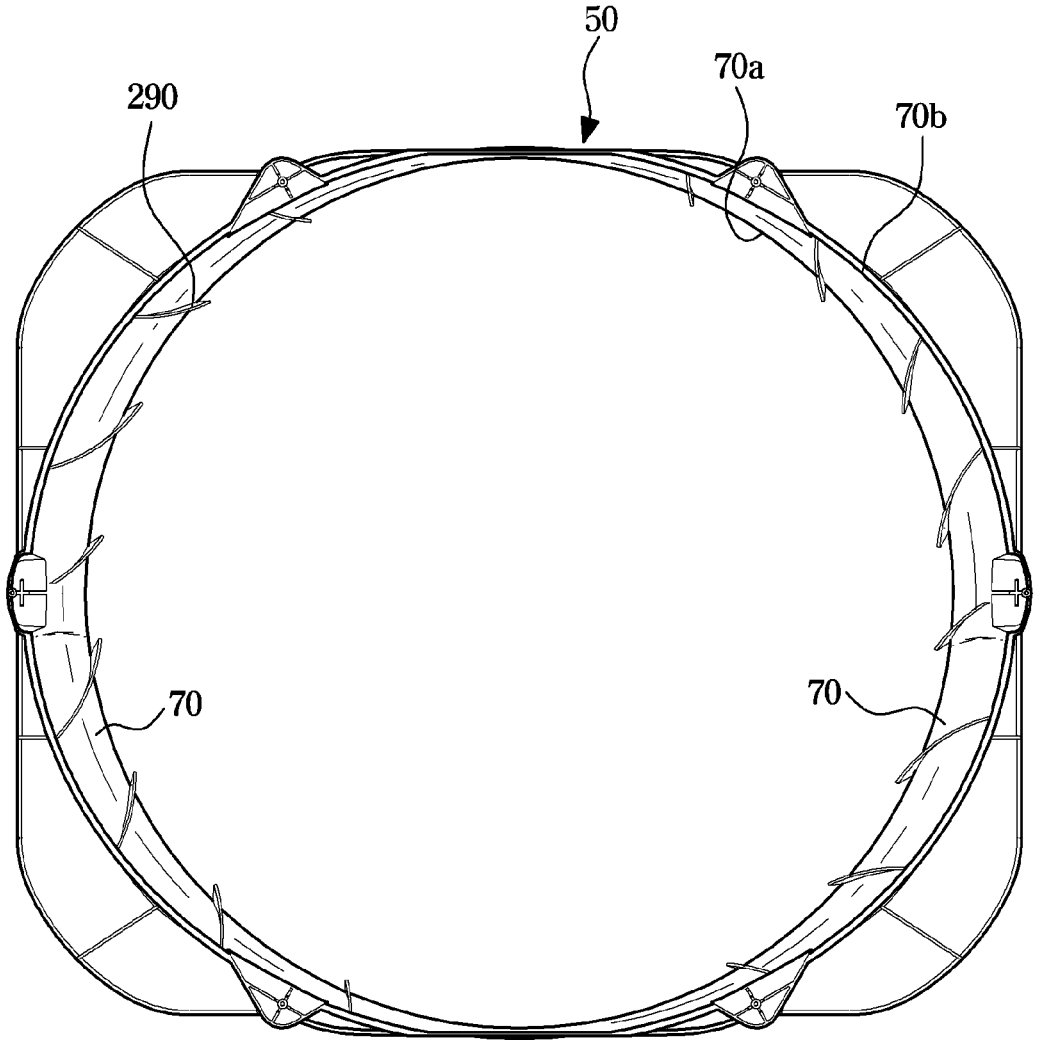
FIG. 10 illustrates a front view of a duct of an outdoor unit of an air conditioner according to another embodiment of the disclosure.

FIG. 9 is a view illustrating a guide of an outdoor unit of an air conditioner according to another embodiment of the disclosure, and FIG. 10 illustrates a front view of a duct of an outdoor unit of an air conditioner according to another embodiment of the disclosure.

Unlike the embodiments described above, the guide vane 80 may also be provided on the diffuser 70.

The guide vane 80 may include a first vane 280 disposed on the bell mouth 64 and a second vane 290 disposed on the diffuser 70. The first vane 280 may be referred to as a bell mouth vane, and the second vane 290 may be referred to as a diffuser vane.

The first and second vanes 280 and 290 may be formed in the same shape.

The first and second vanes 280 and 290 may be formed integrally with the bell mouth 64 and the diffuser 70, respectively. Because the bell mouth 64, the diffuser 70 and the duct 62 are integrally formed by injection molding, the first and second vanes 280 and 290 may be also integrally injection-molded together therewith.

Because the diffuser 70 is configured to be more inclined than the duct 62, the second vane 290 is formed on the inclined diffuser 70. The second vane 290 is configured to change the airflow of air blown from the fan 30. That is, the second vane 290 is configured to change the airflow of air passing through the diffuser 70. The airflow of air blown by the fan 30 is inclined in the rotational direction of the fan 30. The second vane 290 of the diffuser 70 may be configured to guide the air blown from the fan 30 to the outside. The second vane 290 of the diffuser 70 may increase the air flow rate discharged by the fan 30 by guiding the airflow of air blown from the fan 30. As the air flow rate blown by the fan 30 increases, the heat exchange efficiency of the heat exchanger 20 may be improved.

The second vane 290 is configured to extend from the inlet end 70*a* of the diffuser 70 to an arbitrary point on the inner surface of the diffuser 70. However, the disclosure is not limited thereto, and the second vane 290 may extend from the inlet end 70*a* to the outlet end 70*b* of the diffuser 70. The second vane 290 may be formed to protrude spirally from the inlet end 70*a* of the inner surface of the diffuser 70 and to be inclined toward the outlet end 70*b* of the diffuser 70 as the second vane 290 extends to the outlet end 70*b* of the diffuser 70. However, the shape of the second vane 290 is not limited thereto. On the contrary, the second vane 290 may be formed to protrude spirally from the inlet end 70*a* of the inner surface of the diffuser 70 and to be inclined toward the inlet end 70*a* of the diffuser 70 as the second vane 290 extends to the outlet end 70*b* of the diffuser 70.

Because the second vane 290 is formed to an arbitrary point on the inner surface of the diffuser 70 from the inlet end 70*a* of the diffuser 70, the second vane 290 is configured so as not to affect the inner diameter of the duct 62. With this configuration, the fan 30 may not be interfered with the second vane 290 even when the fan 30 protrudes downstream of the duct 62.

Hereinafter an air conditioner according to another embodiment of the disclosure will be described.

A duplicate description of the same configuration as the above-described configuration will be omitted.

Figure 11:
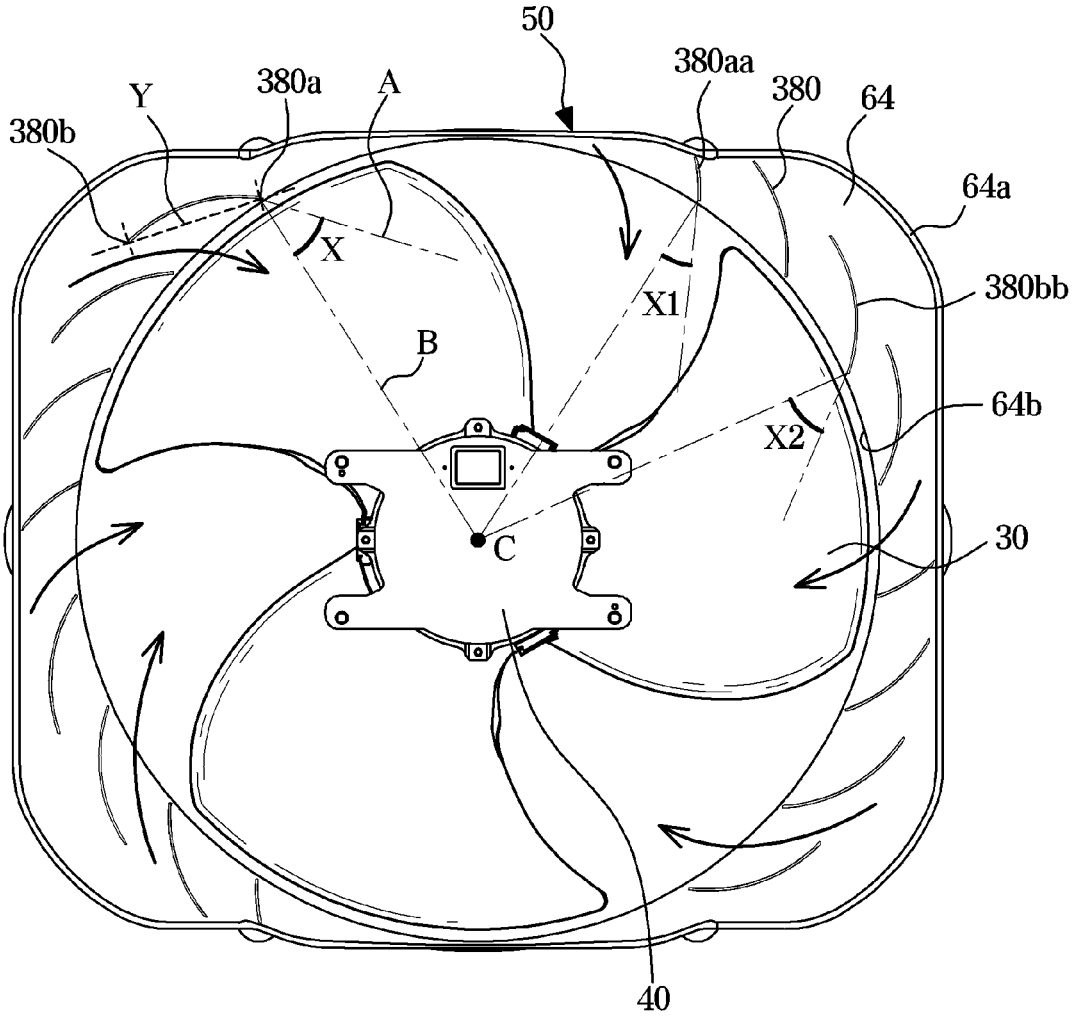
FIG. 11 illustrates a front view of a fan and a guide of an outdoor unit of an air conditioner according to another embodiment of the disclosure.

FIG. 11 illustrates a front view of a fan and a guide of an outdoor unit of an air conditioner according to another embodiment of the disclosure.

As illustrated in FIG. 11, when the guide 50 and the fan 30 are viewed from the front, an angle between the extension line A that is a tangent line at a second end portion 380*a* of a guide vane 380 and the perpendicular line B connecting from the center line C to the second end portion 380*a* of the guide vane 380 may be referred to as an outlet angle (X degrees). The distance of a straight line connecting a first end portion 380*b* and the second end portion 380*a* of the guide vane 380 may be referred to as Y (mm).

A plurality of the guide vanes 380 may be configured such that the angle of X varies according to the length of Y. Specifically, the plurality of guide vanes 380 may be configured such that the larger the angle of X the longer the length of Y. Because the inlet end 64*a* of the bell mouth 64 is formed in a rectangular shape to correspond to the housing 10 of the air conditioner 1, the bell mouth 64 may be configured such that the distance from the inlet end 64*a* to the outlet end 64*b* varies depending on the position.

The outlet angle of a first guide vane 380*aa* disposed at a portion where the distance from the inlet end 64*a* to the outlet end 64*b* of the bell mouth 64 is long may be referred to as X1. The outlet angle of a second guide vane 380*bb* disposed at a portion where the distance from the inlet end 64*a* to the outlet end 64*b* of the bell mouth 64 is short may be referred to as X2. When the first guide vane 380*aa* is configured to be shorter than the second guide vane 380*bb*, X1 and X2 may satisfy the following.

$$X1<X2$$

With this configuration, a change in the airflow along the circumference of the bell mouth 64 may be compensated for by making the outlet angle of the guide vane 380 at a portion where the length of the bell mouth 64 is short small.

As is apparent from the above, according to one aspect of the disclosure, the blowing efficiency of an outdoor unit of an air conditioner can be improved.

According to another aspect of the disclosure, power consumption of the outdoor unit of the air conditioner can be reduced.

According to another aspect of the disclosure, the noise generated from the outdoor unit of the air conditioner can be reduced.

The foregoing has illustrated and described specific embodiments. However, it should be understood that the disclosure is not limited to the above-described embodiments, and various changes and modifications may be made without departing from the technical idea of the disclosure described in the following claims.

Although the present disclosure has been described with various embodiments, various changes and modifications may be suggested to one skilled in the art. It is intended that the present disclosure encompass such changes and modifications as fall within the scope of the appended claims.

What is claimed is:

1. An outdoor unit of an air conditioner comprising:
a housing including an outlet;
a fan disposed inside the housing; and
a guide configured to guide air flowing by the fan, the guide including:
an inflow portion provided to guide air introduced into the housing to the fan, the inflow portion including:
a duct configured to accommodate the fan;
a bell mouth disposed upstream of the duct and configured such that a width of an inlet end of the bell mouth is wider than a width of an outlet end of the bell mouth; and
a plurality of guide vanes arranged circumferentially around an inner surface of the bell mouth and configured to guide air introduced into the fan, and
a diffuser extending from the inflow portion to guide air passing through the fan to the outlet, wherein the duct is connected to the diffuser.

2. The outdoor unit of claim 1, wherein each guide vane is curved from a first end, that is an arbitrary point on the inner surface of the bell mouth, to a second end that is an outlet end of the inner surface of the bell mouth.

3. The outdoor unit of claim 2, wherein the curvature from the first end to the second end is formed in a rotational direction of the fan.

4. The outdoor unit of claim 2, wherein each guide vane is spirally formed from the first end to the second end and is curved toward the outlet end of the bell mouth.

5. The outdoor unit of claim 2, wherein when an angle between an imaginary extension line extending from the second end of each guide vane and a perpendicular line directing to the second end of the guide vane from a center line passing through a center of the guide vane is referred to as an outlet angle, the guide vane is configured to include a longer length as the outlet angle increases.

6. The outdoor unit of claim 2, wherein each guide vane is configured to be inclined in a rotational direction of the fan from the first end to the second end.

7. The outdoor unit of claim 1, wherein:
the bell mouth is formed to slantly expand from the duct in a direction from the outlet end of the bell mouth to the inlet end of the bell mouth in a manner that is inclined; and
the guide vanes are formed on the inner surface of the inclined bell mouth.

8. The outdoor unit of claim 7, wherein the bell mouth is configured in a manner that the inclination of the inner surface of the bell mouth increases toward the inlet end of the bell mouth from the outlet end of the bell mouth.

9. The outdoor unit of claim 1, wherein the duct, the bell mouth, the guide vane, and the diffuser are integrally injection-molded.

10. The outdoor unit of claim 1, wherein an angle, D degrees, between a center line passing through a rotation center of the fan and a tangent line at an outlet end of the diffuser satisfies an equation of $3 \leq D \leq 35$.

11. The outdoor unit of claim 1, wherein:
each guide vane includes a concave inner curved surface and a convex outer curved surface that is an opposite side of the concave inner curved surface; and
each guide vane is configured in a manner that the concave inner curved surface directs to an upstream side of the bell mouth and at least a portion thereof is inclined.

12. The outdoor unit of claim 11, wherein each guide vane is formed to protrude further toward an upstream side of the guide than the inlet end of the bell mouth.

13. The outdoor unit of claim 1, wherein:
the diffuser is formed to slantly extend from the duct in a direction from an inlet end of the guide to an outlet end of the guide; and
the guide includes a diffuser vane configured to be curved from a first end, that is an inlet end of the diffuser, to a second end that is an arbitrary point of the diffuser.

14. The outdoor unit of claim 1, wherein the fan includes an axial flow fan configured to blow air that is introduced into the bell mouth disposed in front of the fan to the diffuser disposed behind the fan.

15. An outdoor unit of an air conditioner comprising:
a housing provided with an outlet;
a fan disposed inside the housing; and
a guide configured to guide air flowing by the fan, the guide including:
a duct configured to accommodate the fan,
a diffuser extending from an outlet end of the duct to discharge air passing through the fan,
a bell mouth extending from an inlet end of the duct and configured in a manner that a width of an inlet end of the bell mouth is wider than a width of an outlet end of the bell mouth, and
a plurality of guide vanes arranged circumferentially around an inner surface of formed on the bell mouth and curved to guide air introduced into the fan, each guide vane including:
a first end positioned at the outlet end of the bell mouth; and
a second end opposite to the first end, and
wherein each guide vane is inclined in a rotational direction of the fan from the first end to the second end.

16. The outdoor unit of claim 15, wherein each guide vane is gradually inclined from the first end to the second end.

17. The outdoor unit of claim 15, wherein each guide vane is formed to protrude further toward an upstream side of the guide than the inlet end of the bell mouth.

18. The outdoor unit of claim 15, wherein each guide vane is spirally formed from the first end to the second end and is configured to be curved toward the outlet end of the bell mouth.

19. The outdoor unit of claim 15, wherein:

the bell mouth is formed to slantly expand from the duct in a direction from the outlet end of the bell mouth to the inlet end of the bell mouth in a manner that is inclined; and the guide vane is formed on the inner surface of the inclined bell mouth.

20. The outdoor unit of claim 19, wherein the bell mouth is configured in a manner that the inclination of the inner surface of the bell mouth increases toward the inlet end of the bell mouth from the outlet end of the bell mouth.

* * * * *